US007073901B2

(12) United States Patent
Mills et al.

(10) Patent No.: US 7,073,901 B2
(45) Date of Patent: Jul. 11, 2006

(54) RADIATION TREATMENT FOR INK JET FLUIDS

(75) Inventors: Stephen J. Mills, Plymouth, NH (US); Michael D. Mills, Moultonboro, NH (US); Adam C. Lahut, Moultonboro, NH (US); Arthur L. Cleary, Center Harbor, NH (US); Joseph A. Lahut, Center Harbor, NH (US)

(73) Assignee: Electronics For Imaging, Inc., Foster City, CA (US)

( * ) Notice: Subject to any disclaimer, the term of this patent is extended or adjusted under 35 U.S.C. 154(b) by 51 days.

(21) Appl. No.: 10/172,761

(22) Filed: Jun. 13, 2002

(65) Prior Publication Data

US 2003/0035037 A1 Feb. 20, 2003

Related U.S. Application Data

(63) Continuation-in-part of application No. 09/834,999, filed on Apr. 13, 2001, now Pat. No. 6,457,823.

(60) Provisional application No. 60/326,691, filed on Oct. 2, 2001.

(51) Int. Cl.
*B41J 2/01* (2006.01)

(52) U.S. Cl. ..... 347/102; 34/273

(58) Field of Classification Search ..... 347/102; 34/275, 276, 273

See application file for complete search history.

(56) References Cited

U.S. PATENT DOCUMENTS

| | | | | |
|---|---|---|---|---|
| 4,340,893 | A | 7/1982 | Ort | |
| 4,970,528 | A | 11/1990 | Beaufort et al. | |
| 5,036,128 | A * | 7/1991 | Durand | 524/440 |
| 5,041,846 | A | 8/1991 | Vincent et al. | |
| 5,130,726 | A * | 7/1992 | Fukushima et al. | 347/102 |
| 5,220,346 | A | 6/1993 | Carreira et al. | |
| 5,294,946 | A | 3/1994 | Gandy et al. | |
| 5,376,957 | A | 12/1994 | Gandy et al. | |
| 5,397,673 | A * | 3/1995 | Watson et al. | 430/126 |
| 5,638,098 | A | 6/1997 | Iwata et al. | |
| 5,732,633 | A | 3/1998 | Herskowits | |
| 6,092,890 | A * | 7/2000 | Wen et al. | 347/101 |
| 6,145,979 | A | 11/2000 | Caiger et al. | |
| 6,172,741 | B1 * | 1/2001 | Wotton et al. | 355/73 |
| 6,312,123 | B1 | 11/2001 | Codos et al. | |
| 6,328,397 | B1 * | 12/2001 | Shimizu et al. | 347/10 |
| 6,350,071 | B1 * | 2/2002 | Conwell et al. | 400/118.2 |
| 6,457,823 | B1 * | 10/2002 | Cleary et al. | 347/102 |
| 6,536,889 | B1 * | 3/2003 | Biegelsen et al. | 347/95 |

FOREIGN PATENT DOCUMENTS

| | | |
|---|---|---|
| EP | 0 284 215 B1 | 1/1992 |
| EP | 0 622 194 B1 | 9/1997 |
| GB | 2142579 B | 1/1985 |
| JP | 60-132767 | 7/1985 |
| JP | 61-209163 | 9/1986 |
| JP | 63-62738 | 3/1988 |
| WO | WO 97/04964 | 2/1997 |

OTHER PUBLICATIONS

Panico, Louis R., "Pulsed UV Curing", *XENON Corporation,* no date given, pp. 1-9.

* cited by examiner

*Primary Examiner*—Stephen Meier
*Assistant Examiner*—Ly T. Tran

(57) ABSTRACT

A printing system that includes a source which emits UV radiation to polymerize a fluid that is deposited onto a substrate by one or more print heads. The source emits low energy UV radiation sufficient to set the fluid to a quasi-fluid, non-hardened state.

31 Claims, 16 Drawing Sheets

RADIATION TREATMENT FOR INK JET FLUIDS

RELATED APPLICATIONS

This application claims the benefit of U.S. Provisional Application No. 60/326,691, filed Oct. 2, 2001, and is a continuation-in-part of U.S. application Ser. No. 09/834,999, filed Apr. 13, 2001 is now U.S. Pat. No. 6,457,823. The entire contents of the above applications are incorporated herein by reference.

BACKGROUND

Certain types of printing systems are adapted for printing images on large-scale substrates, such as for museum displays, billboards, sails, bus boards, and banners. Some of these systems use so-called drop on demand ink jet printing. In these systems, a carriage which holds a set of print heads scans across the width of the substrate while the print heads deposit ink as the substrate moves.

Solvent based inks are sometimes used in these systems in which an infrared dryer is used to dry off the solvent after the ink is deposited onto the substrate. Systems using solvent based inks are able to print on flexible substrates such as PVC materials and reinforced vinyl. However, solvent based inks are typically considered to be unusable for printing on rigid substrates such as metals, glass, and plastics. Therefore, to print on rigid, as well as flexible substrates, radiation-curable inks such as UV-curable inks are often preferred. For these systems, the ink is deposited onto the substrate and then cured in a post-printing stage. For instance, after the deposition of the ink, the substrate moves to a curing station. The ink is then cured, for example, by exposing it to UV radiation. In other systems, the UV radiation source for curing is mounted directly on the same carriage that carries the set of print heads.

SUMMARY

During the printing process, UV curable ink must be cured within a short time period after it has been deposited on the substrate, otherwise ink with positive dot gain may spread out and flow, or ink with negative dot gain may ball up. UV radiation sources mounted on the carriage are capable of emitting radiation at high enough energies to cure the ink within such time frames. However, a significant amount of power must be supplied to the UV radiation source to enable it to emit these high energies. Typical UV radiation sources are quite inefficient since most of the emitted radiation is unusable. A substantial percentage of the emitted radiation is not used because the source emits radiation with wavelengths over a spectrum which is much wider than the usable spectrum. In addition, to ensure that the required amount of radiation is transmitted to the ink, the carriage must scan across the substrate at moderate speeds, even though the print heads are capable of depositing ink onto the substrate at much higher carriage speeds.

It is desirable, therefore, to set (i.e. pre-cure) the ink rather than fully cure it as the ink is deposited on the substrate so that the ink does not spread or ball up, even though it is still in a quasi-fluid state (i.e. the ink is not completely hardened). Such an arrangement requires less power, and, therefore, facilitates using smaller UV radiation sources. In addition, a lower energy output requirement would allow the carriage to operate at a higher speed. Hence, images can be printed at a higher rate, resulting in a higher throughput.

The present invention implements an apparatus and method for setting radiation curable ink deposited on a substrate. Specifically, in one aspect of the invention, an ink jet printing system includes a UV energy source which emits pulsed UV radiation to polymerize a fluid that is deposited onto a substrate by one or more ink jet print heads. In some embodiments, the radiation emitted by the energy source is adjustable. The energy source is able to emit low energy UV radiation to set the fluid, as well as a higher energy UV radiation to cure the fluid. In certain embodiments, the fluid is first set and subsequently cured. The fluid can be an ink that is UV curable, or the fluid can be any other type of polymerizable fluid that does not necessarily contain a dye or pigment.

In some embodiments, the energy required to set the fluid or ink to a quasi-fluid, non-hardened state is between about 5% to 50% of the energy necessary to cure the fluid or ink to a hardened state. As such, since the cure energy is typically between about 200 mj/cm$^2$ to 800 mj/cm$^2$ for many polymerizable fluids, such as UV treatable inks, the set energy can be between about 10 mj/cm$^2$ to 400 mj/cm$^2$.

Embodiments of this aspect can also include one or more of the following features. The print heads can be positioned in a carriage which scans in a direction substantially traverse to the direction of movement of the substrate. In certain embodiments, the carriage is able to move bidirectionally. And in others, the energy source is moveable relative to the carriage in a direction substantially perpendicular to the traverse direction.

In some embodiments, the UV energy source is a pair of lamps mounted to a carriage of the printing system that scans across the substrate. The lamps can be moveable relative to the carriage. The system can also include a feedback system which controls the pulse rate of the UV energy source. In certain embodiments, the feedback system converts the pulse rate to pulses per inch of linear travel of the energy source.

In yet other embodiments, the print heads are a non-moveable fixed array of print heads. The energy source includes a first UV energy source which sets the liquid and a second UV energy source which cures the liquid. The first energy source is positioned at a trailing end of the array and the second energy source is positioned adjacent to a trailing side of the first energy source In another embodiment, the print heads include one or more series of print heads arranged in a non-moveable fixed array, and an equal number of setting energy sources. Each energy source is capable of setting the fluid and is positioned adjacent to a respective series of print heads. The energy source also includes a curing UV energy source which cures the fluid. The curing UV energy source is positioned at a trailing end of the array of print heads and the setting energy sources.

In yet another aspect, the invention implements a method and apparatus with a radiation source which emits a set energy sufficient to set the ink to a non-hardened, quasi-fluid state. The radiation source can emit continuous UV radiation or pulsed UV radiation. The set energy can be substantially less than a cure energy required to fully cure the ink to a hardened state. The set energy can be about 50% or less than the cure energy. The energy level of the radiation source can be adjustable from a low level to set the ink to a higher level to cure the ink.

Some embodiments of the invention may have one or more of the following advantages. The pulsed UV energy source is able to set and cure printed material with less heat since it generates less IR. When printing on certain substrates, for example those that are corrugated, continuous UV lamps produce a temperature gradient through the thickness of the substrate, thereby causing the substrate to warp. With pulsed UV energy sources, this temperature gradient is minimized and hence less warping occurs. Furthermore, with less heat being produced there is a smaller chance of a fire occurring.

In addition, because most of the energy produced by pulsed UV energy sources is usable, they are highly efficient. Unlike some continuous UV energy sources which have to remain ON, pulsed UV energy sources can be quickly turned OFF and ON since they require little or no warm up time. Hence, when the UV energy is not needed, for example, when the carriage is changing directions, the pulsed UV energy sources can be turned OFF. Another advantage of pulsed UV energy sources is that the amount of energy emitted over an area of printed material can be precisely controlled regardless how fast or slow the carriage scans across the substrate. That is, the amount of energy emitted from the pulsed UV energy sources can be quickly changed to accommodate varying speeds of the carriage.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
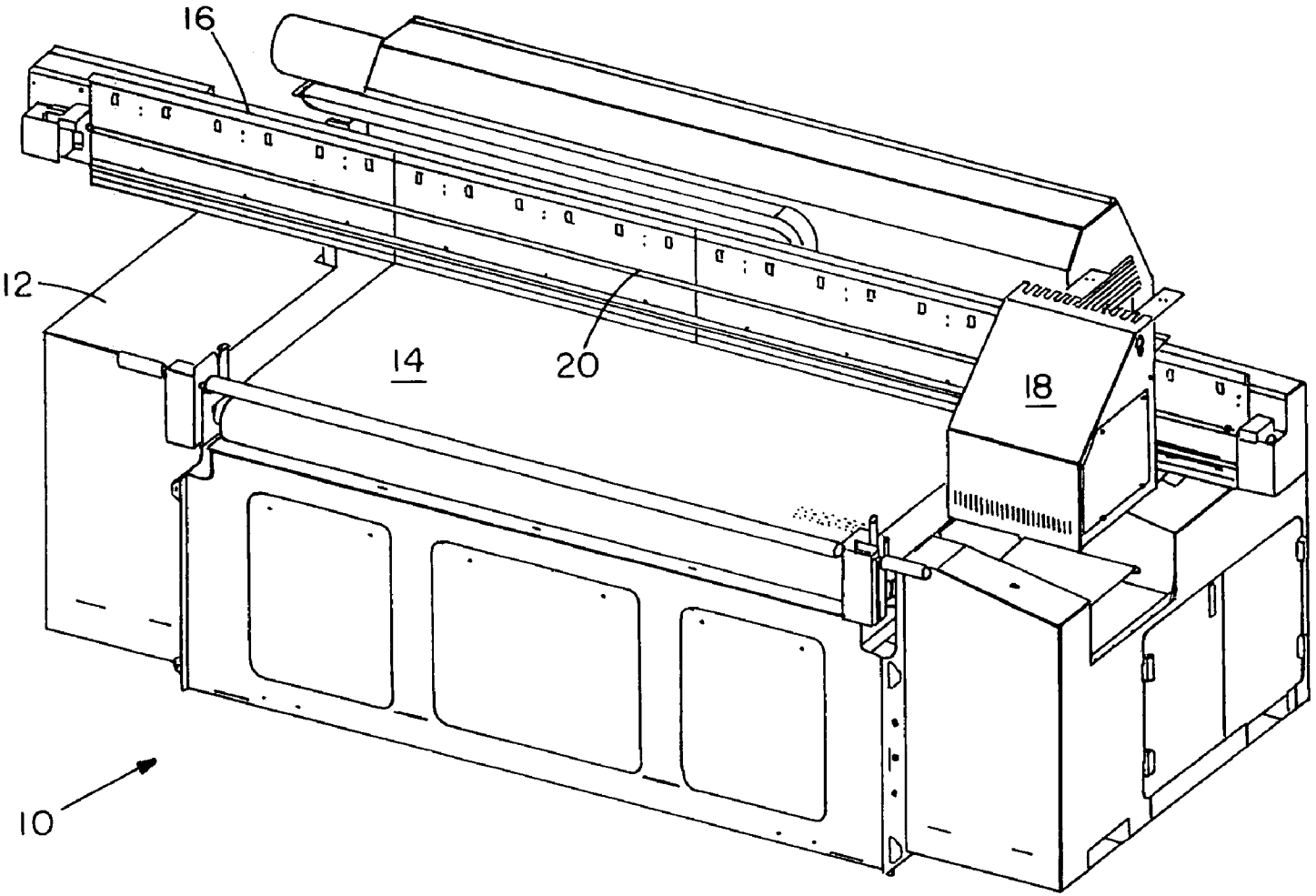
FIG. 1 is an perspective view of a printing system in accordance with the invention.

Turning now to the drawings, there is shown in FIG. 1 a printing system 10 adapted for printing images on a variety of substrates. Typical substrates are polyvinyl chloride (PVC) and reinforced vinyl which can be provided with peel-off backings to expose pressure sensitive adhesive. The printing system 10 is able to print on flexible as well as on non-flexible substrates, for example, metals, glass, and plastics. The inks deposited on the substrate is UV curable. That is, the inks contain binders and colorants, as well as photoinitiators and surfactants. The surfactants are present in the ink to ensure that the ink is stable when in the liquid state. The binder generally consists of a blend of monomers and oligimers, and the photoinitiators are used to catalyze the polymerization reaction during which the monomers and/or oligimers are joined together to be become a polymeric binder. The polymerization generally occurs through a free-radical reaction process. When the energy from a UV source contacts the photoinitiator, the photoinitiator breaks a double bond in the monomers and/or oligimers. This produces new molecules that are free radicals which link together with other free radicals until the long chain polymer undergoes a termination reaction, or the free radicals are depleted. At this point, the binder is now a solid film of polymers that hold the colorant, which consists of pigments and/or dyes, to the substrate.

The printing system 10 includes a base 12, a transport belt 14 which moves the substrate through the printing system, a rail system 16 attached to the base 12, and a carriage 18 coupled to the rail system 16. The carriage 18 holds a series of inkjet print heads and one or more radiation sources, such as UV radiation sources, and is attached to a belt 20 which wraps around a pair of pulleys (not shown) positioned on either end of the rail system 16. A carriage motor is coupled to one of the pulleys and rotates the pulley during the printing process. As such, when the carriage motor causes the pulley to rotate, the carriage moves linearly back and forth along the rail system 16.

Figure 2A:
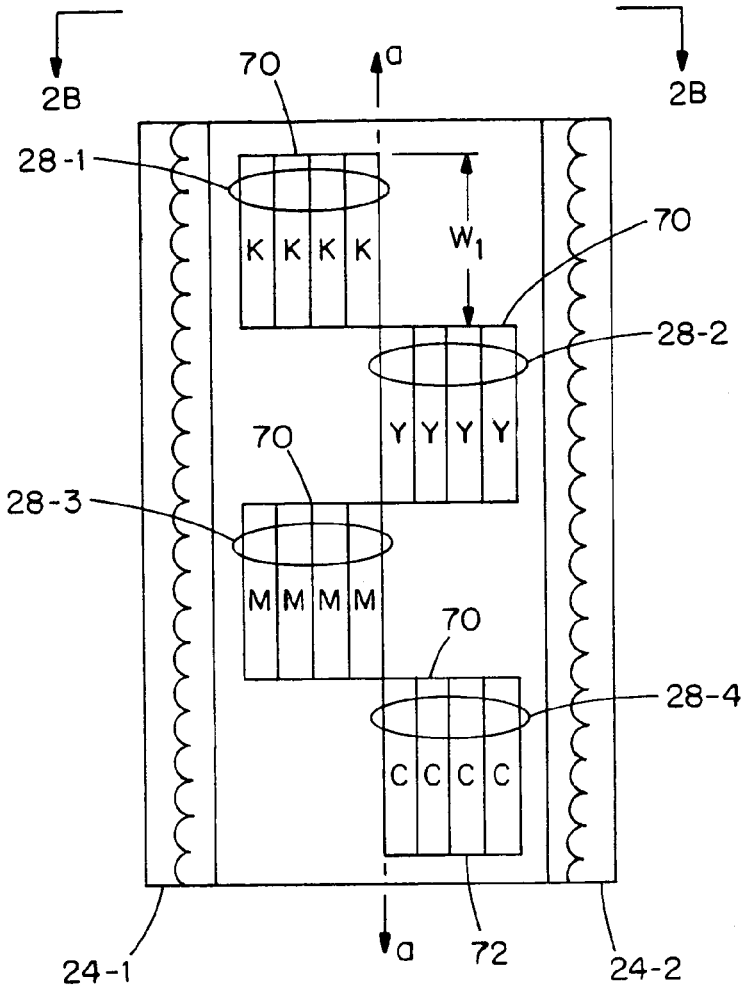
FIG. 2A is a bottom view of a carriage of the printing system of FIG. 1 holding a series of inkjet print heads and a pair of UV radiation sources.
Figure 2B:
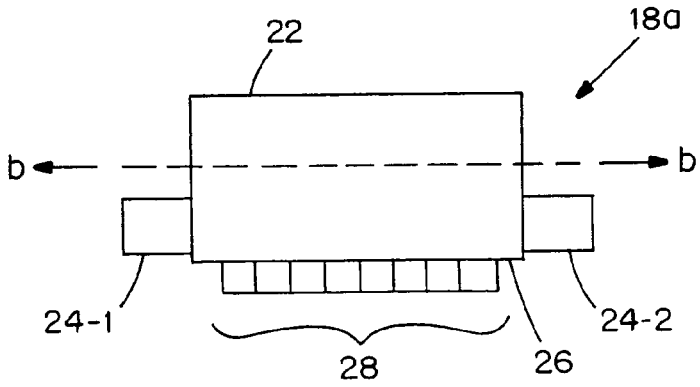
FIG. 2B is a view along line 2B—2B of the carriage of FIG. 2A.
Figure 3:
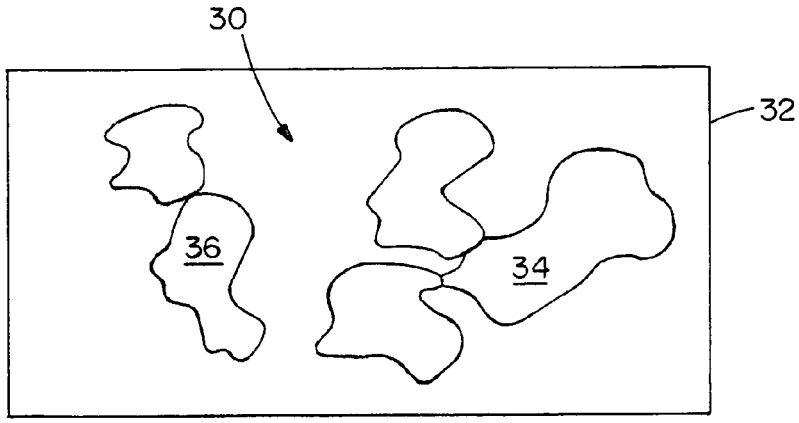
FIG. 3 is a schematic of an image printed by the printing system of FIG. 1.

The print heads and the UV radiation sources mounted to the carriage are illustrated in more detail in FIGS. 2A and 2B. As shown, a carriage 18*a* includes a housing 22 encasing a pair of UV radiation sources 24-1 and 24-2 attached to and positioned on either side of a carriage frame 26. (Note that specific embodiments of the carriage 18 will be further identified by a lower case letter.) A series of "drop on demand" inkjet print heads 28 is also mounted on the carriage frame 26 and positioned between and laterally adjacent to the UV radiation sources 24. The series of inkjet print heads 28 includes a set of black (K) print heads 28-1, a set of yellow (Y) print heads 28-2, a set of magenta (M) print heads 28-3, and a set of cyan (C) print heads 28-4. Each set of print heads 28 is positioned on either side of an axis, a—a, that is substantially orthogonal to an axis, b—b, along which the carriage 18*a* traverses. The print heads 28 are arranged so that during the printing process the black print heads 28-1 first deposit black ink, then the yellow print heads 28-2 deposit yellow colored ink, followed by the deposition of magenta ink from the magenta print heads 28-3, and finally the cyan print heads 28-4 deposit cyan colored ink. These colors alone and in combination are used to create a desired image 30 on a substrate 32 (FIG. 3). Thus, the image 30 is made of regions having no ink or one to four layers of ink. For example, a green region 34 of the image 30 is produced by depositing two layers of ink, namely, yellow and cyan. And an intense black region 36 of the image 30 results from dispensing all four colors, cyan, magenta, yellow, and black. As such, this intense black region 36 is made of four layers of ink.

Although certain regions of the image 30 are made with multiple layers of ink, and all four sets of the print heads 28 may simultaneously deposit ink onto the substrate 32, only one layer of ink is deposited at a given time on the portion of the substrate that is positioned beneath a respective set of print heads as the carriage scans across the substrate.

Figure 4A:
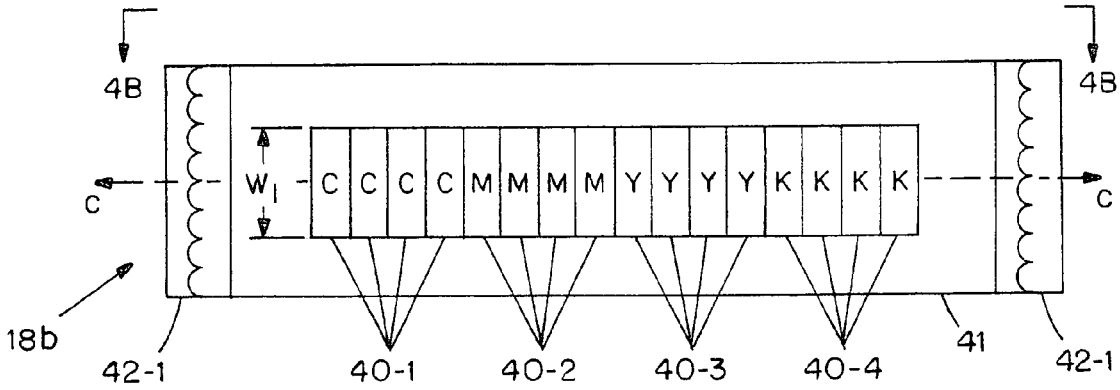
FIG. 4A is a bottom view of an alternative embodiment of the carriage of the printing system of FIG. 1.
Figure 4B:
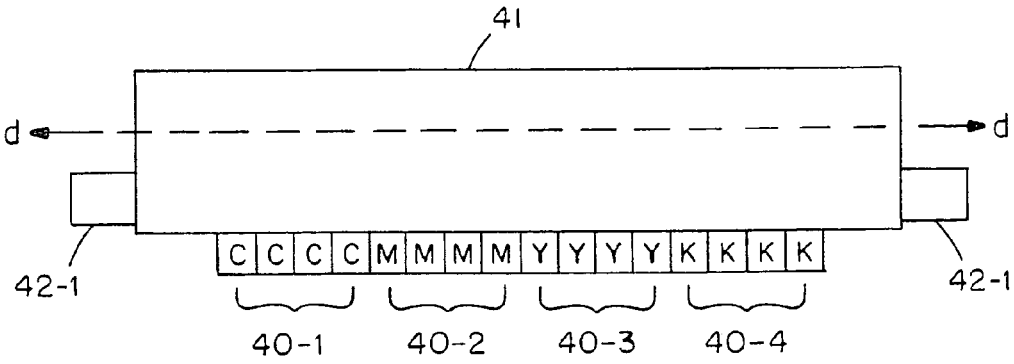
FIG. 4B is a view along line 4B—4B of the carriage of FIG. 4A.

An alternative embodiment of the invention is illustrated in FIGS. 4A and 4B, where a carriage 18*b* holds a series of ink jet print heads 40 which may deposit four layers of ink simultaneously on the region of substrate located beneath the four sets of print heads 40-1, 40-2, 40-3, 40-4. In this embodiment, the set of cyan (C) print heads 40-1, the set of magenta (M) print heads 40-2, the set of yellow (Y) print heads 40-3, and the set of black (K) print beads 40-4 are positioned on a carriage frame 41 and aligned along an axis, c—c, that is substantially parallel to an axis, d—d, of travel of the carriage 18*b*. The print heads 40 are positioned between a pair of UV radiation sources 42-1 and 42-2 attached on either side of the carriage frame 41.

Figure 5A:
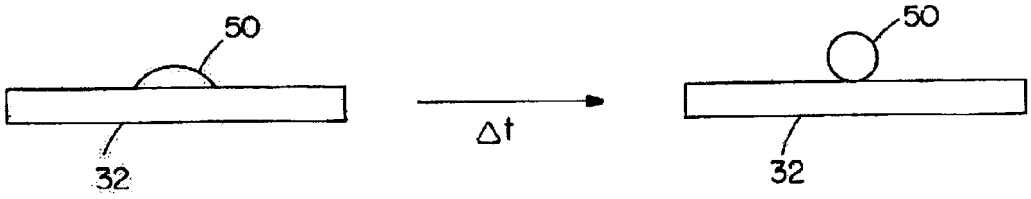
FIG. 5A is an illustrated time sequence of ink deposited on a substrate by the printing system of FIG. 1 for droplets having negative dot gain.
Figure 5B:
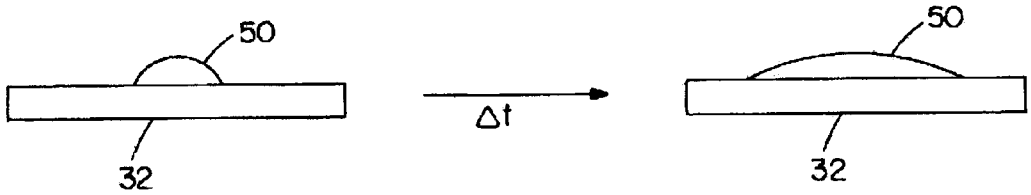
FIG. 5B is an illustrated time sequence of ink deposited on a substrate by the printing system of FIG. 1 for droplets having positive dot gain.

A typical ink jet printing ink has a viscosity of about 10 centipoise. Thus, as shown in FIG. 5A, ink 50 deposited on the substrate 32, over time some time period $\Delta t$, will contract and ball up because of the low liquid viscosity and surface tension effects, exhibiting what is known as negative dot gain. In some instances the ink exhibits positive dot gain behavior as shown in FIG. 5B, where after the ink 50 is deposited on the substrate 32, the ink expands and spreads out. To prevent either of these behaviors, the UV radiation sources 24-1 and 24-2 of the carriage 18*a* (FIG. 2), or the UV radiation sources 42-1 and 42-2 of the carriage 18*b* (FIG. 4) expose the ink with UV radiation after the deposition of the ink onto the substrate. The amount of energy, referred to as the "set energy," is sufficient to cause the ink to set. In prior art printing systems which cure the deposited ink, the UV radiation sources emit with a power output of about 300 W/inch for a linear carriage speed of about 20 in/sec to provide 800 mj/cm$^2$ which is the energy required to cure the ink. The set energy, however, is typically about 5% of the cure energy, that is, about 40 mj/cm$^2$. Thus, for a carriage speed of 20 in/sec, approximately 15 W/inch is required to set the ink. In the present printing system 10, the carriage speed ranges from about 10 inch/sec to about 60 inch/sec. The UV radiation sources 24-1 and 24-2 of the carriage 18*a* (or 42-1 and 42-2 of the carriage 18*b*), therefore, must emit at about 50 W/inch to set the ink at the higher carriage speed to provide the necessary 40 mj/cm$^2$. Of course, 50 W/inch will be more than adequate to set the ink at the lower carriage speed but below that for curing the ink, since the 50 W/inch at a carriage speed of 10 inch/sec would correspond to about 240 mj/cm$^2$. Note that in some implementations, the amount of energy required to cure can be as low as 200 mj/cm$^2$. Also, in these as well as other implementations, the set energy is about 50% of the cure energy. Thus, depending on the application, the cure energy is between about 200 mj/cm$^2$ to 800 mj/cm$^2$. As such, the set energy can be as low as about 10 mj/cm$^2$ (or 5% of 200 mj/cm$^2$), and as high as about 400 mj/cm$^2$ (or 50% of 800 mj/cm$^2$).

Figure 6:
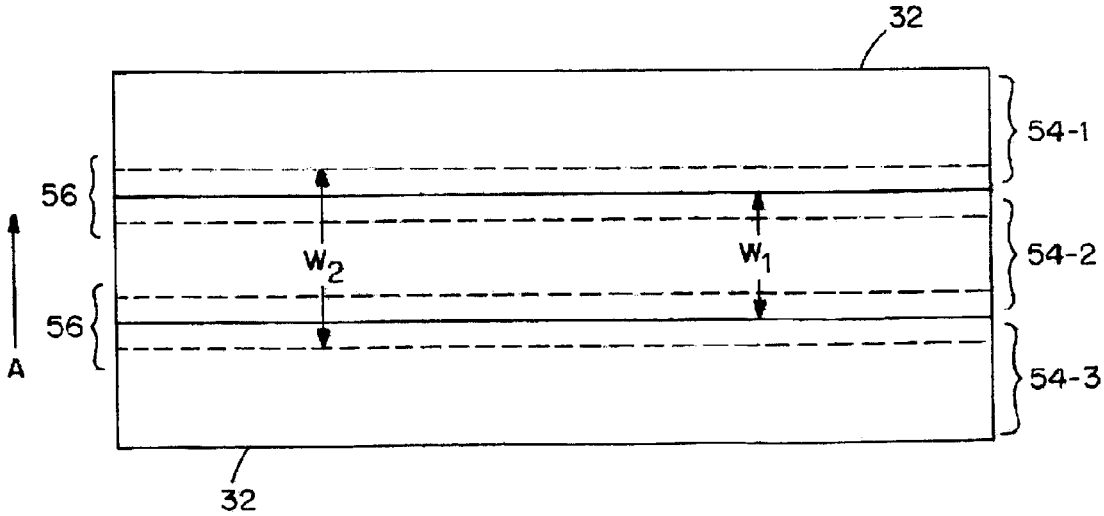
FIG. 6 is an illustration of a sequence of paths of the print heads of the printing system of FIG. 1.

Referring to FIG. 6, as the carriage 18*b* (FIGS. 4A and 4B) traverses across the substrate 32, the print heads 40 mounted on the carriage create a sequence of paths 54 of deposited ink on the substrate 32. The print heads 40 deposit ink along a first path 54-1, then a second path 54-2, followed by a third path 54-3 and so on as the carriage 18*b* goes back and forth across the substrate 32 while the substrate moves through the printing system in the direction A. These paths 54 have a width, "$w_1$," of about two inches which correspond to the length of the print heads 40 (as well as that of the print heads 28 mounted on the carriage 18*b*). During the deposition of ink along each path, however, the width, "$w_2$," of the region exposed to UV radiation from the UV radiation sources 42-1 and 42-2 is about three inches. This region is wider than $w_1$ to ensure that the ink deposited onto the substrate is not under exposed. There is, therefore, a sequence of regions 56 exposed to UV radiation twice as the carriage 18*b* scans back and forth across the substrate 32.

Note that the print heads 28 of the carriage 18*a* (FIGS. 2A and 2B) also generate a similar sequence of print paths with overlap regions which are exposed multiple times to radiation emitted by the radiations sources 24-1 and 24-2. But rather than being exposed to the UV radiation twice as with the arrangement of carriage 18*b*, these overlap regions are exposed to the radiation five times because of the arrangement of the print beads 28. That is, the overlap region 56 is exposed for each pass of a respective print head 28 corresponding to a top edge 70 of each set of the print heads 28. This region is then exposed a fifth time which corresponds to a bottom edge 72 of the cyan print heads 28-4.

Recall that about 800 mj/cm$^2$ is required to cure the ink and about 40 mj/cm$^2$ is necessary to set the ink. Therefore, at first blush, for the printing system 10 using the carriage 18*a*, it would appear that the overlap regions 56 are exposed to about 200 mj/cm$^2$ (5× of 40 mj/cm$^2$) for carriage speeds of 60 inch/sec and 1200 mj/cm$^2$ for carriage speeds of 10 inch/sec. Although 200 mj/cm$^2$ is well below the amount of energy required to the cure the ink, 1200 mj/cm$^2$ is well above the required cure energy. However, a 30× exposure of 40 mj/cm$^2$ is not equivalent to a single exposure of 1200 mj/cm$^2$.

Figure 7A:
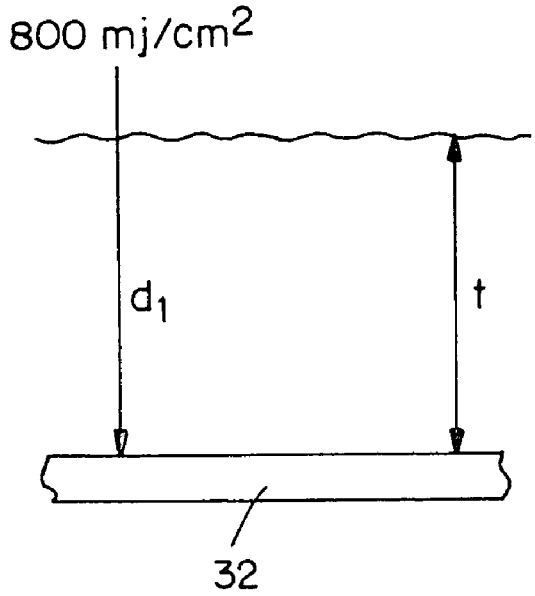
FIG. 7A is a schematic illustration of a penetration depth through ink deposited on a substrate for a UV radiation source having an intensity of about 800 mj/cm$^2$.
Figure 7B:
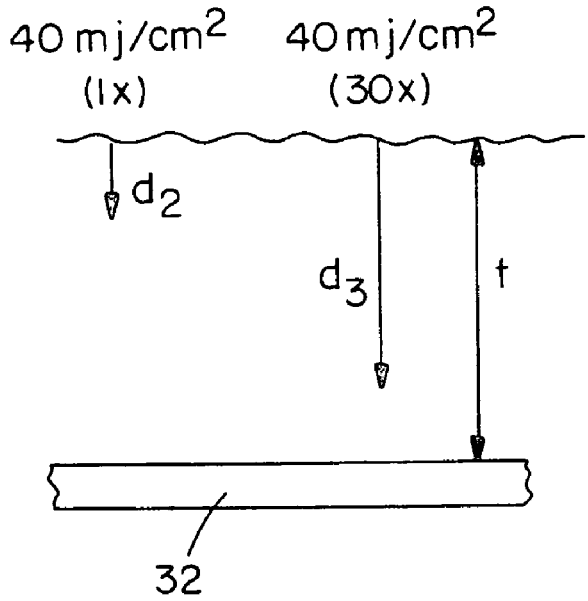
FIG. 7B is a schematic illustration of the penetration depth through ink deposited on a substrate for a UV radiation source having an intensity of about 40 mj/cm$^2$ for a single exposure and for multiple exposures.
Figure 8A:
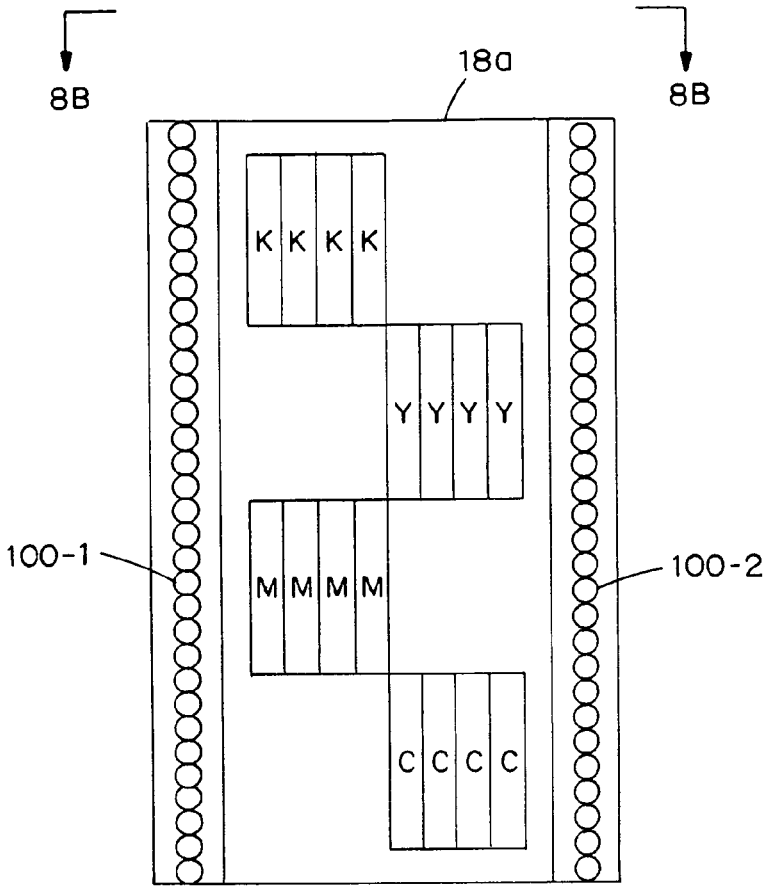
FIG. 8A is a bottom view of the carriage of FIG. 2A with a set of LED UV radiation sources.
Figure 8B:
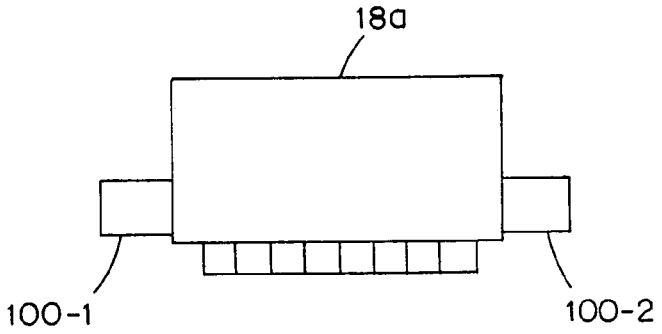
FIG. 8B is a view along line 8B—8B of FIG. 8A.
Figure 9A:
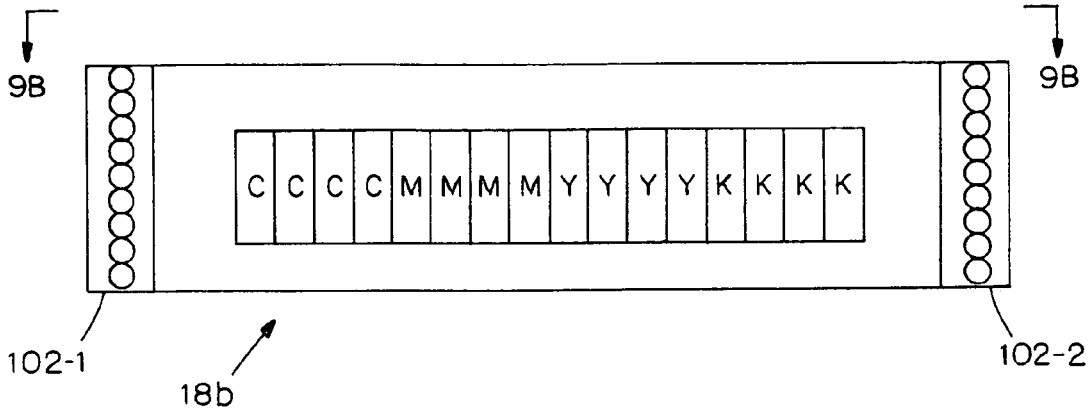
FIG. 9A is a bottom view of the carriage of FIG. 3A with a set of LED UV radiation sources.
Figure 9B:
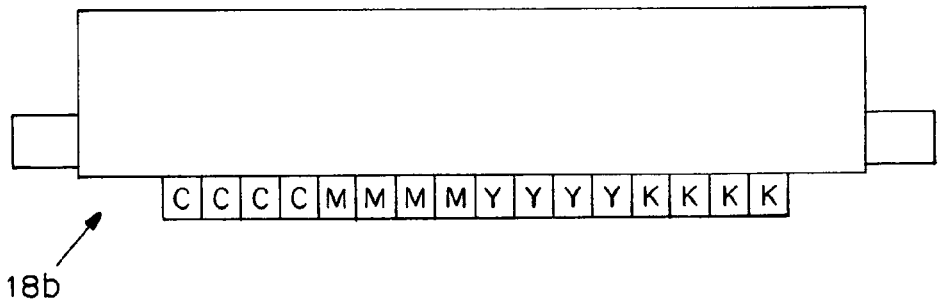
FIG. 9B is a view along line 9B—9B of FIG. 9A.

This is best illustrated with reference to FIG. 7. As illustrated in FIG. 7, for a single exposure of radiant energy of 800 mj/cm$^2$, the radiant energy penetrates to a depth, "$d_1$," which is equivalent to the thickness, "t," of the deposited ink. That is, the ink is fully cured because the radiant energy is able to penetrate through the entire thickness of the ink. And for a single exposure of 40 mj/cm$^2$, the radiation penetrates to a depth of $d_2$. But for a 30× exposure of 40 mj/cm$^2$, the total accumulated penetration depth is $d_3$ which is significantly less than $30 \times d_2$, and in fact is less than $d_1$. Thus, with the carriage 18*a* operating at a scan speed of 10 inch/sec, the energy the ink receives is sufficient to set the ink but not to cure it.

Figure 10:
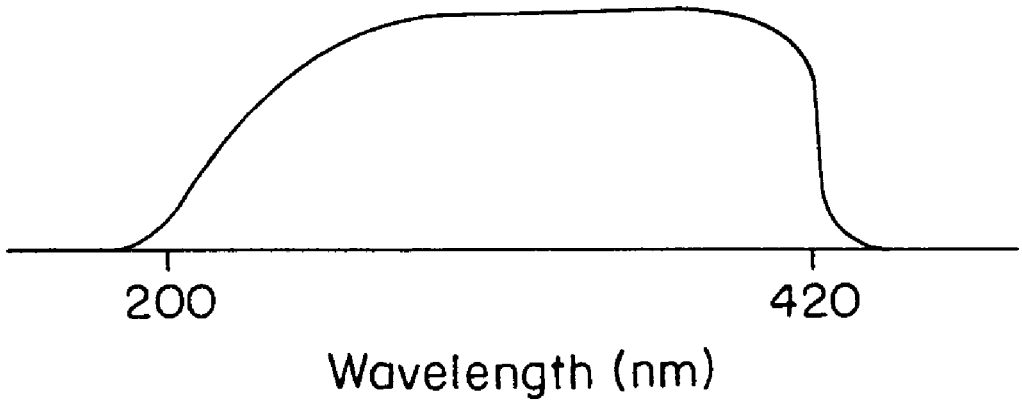
FIG. 10 is an illustrative comparison between the spectrum of a standard UV radiation source and the spectrum of a LED UV radiation source.
Figure 10:
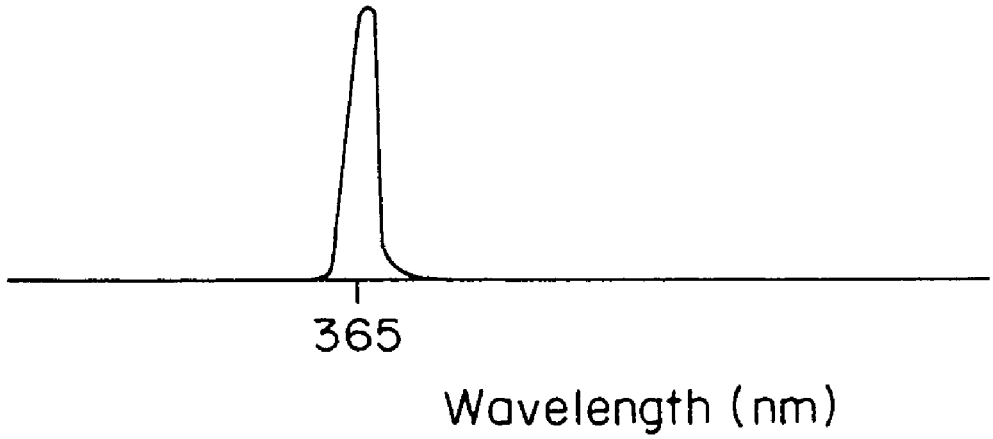
Figure 11:
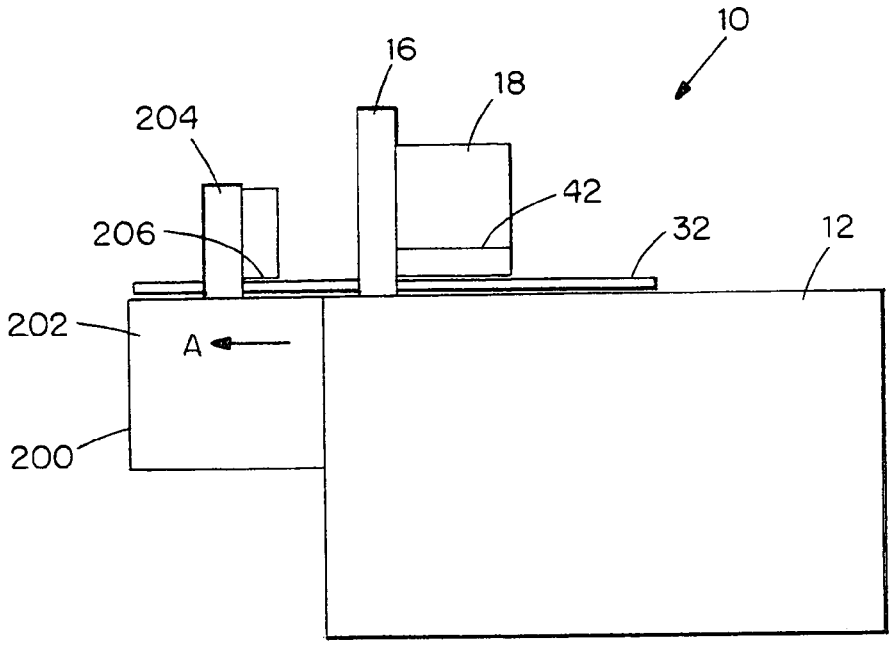
FIG. 11 is an illustration of the printing system with an attached curing station.

With most UV radiation sources, much of the radiation transmitted by the source is unusable. For example, traditional glow bulbs emit energy from a wavelength of about 200 nm to about 420 nm (FIG. 10A). However, typical UV-curable ink requires UV radiation with a wavelength of about 365 nm to photoinitiate the setting and subsequent curing of the ink. Thus, up to 95% of the emitted radiation is wasted. Thus in alternative embodiments, as illustrated in FIGS. 8A and 8B and FIGS. 9A and 9B, the carriage 18*a* and the carriage 18*b* are provided with light emitting diodes (LEDs) 100 which emit the UV radiation. These LEDs are tuned to emit at the wavelength of 365 nm over a very narrow bandwidth (FIG. 10B).

Further, traditional glow bulbs, for example, mercury vapor lamps, require about 3000 volts to provide the required energy to cure the ink. But when the voltage supplied to traditional glow bulbs is reduced to provide the set energy (5% of the cure energy), the ends of the lamp cool initially and the plasma extinguishes at these ends. As such, the traditional glow bulb is unable to provide a uniform radiation source along its length for both curing and setting applications. LEDs, however, can be pulse-width modulated so that the ends of the radiation source do not extinguish which ensures that the radiation emitted by the LED radiation sources is uniform along the length of the radiation source regardless whether the radiation source is used to cure and/or to set the ink.

Other features of LEDs make them highly desirable for use as UV radiation sources. For instance, LEDs weigh less, require less energy to operate, do not emit wasteful energy, and are physically smaller.

The above discussion has been directed to printing systems with a UV setting capability. However, as illustrated in FIG. 1, the system can be combined with a curing station. As shown there, the printing system 10 is provided with the carriage 18 which holds the ink jet print heads and the UV radiation sources for setting the UV curable ink, as discussed previously. In addition, the printing system 10 includes a curing station 200 attached to the base of the printing system 10. The curing station 200 has a station base 202 upon which is mounted a stand 204. A UV-curing source 206 is supported by the stand 204. Thus, as the substrate 32 progresses through the printing system 10 in the direction A, the print heads of the carriage 18 deposit ink onto the substrate while the radiation sources 42 (or alternatively sources 28 of carriage 18*a*) transmit energy to the ink deposited onto the substrate to set and fix the ink in place. Subsequently, that portion of the substrate moves to the curing station 200. The UV-curing source 206 then emits a sufficient amount of energy to fully cure the ink.

Figure 12:
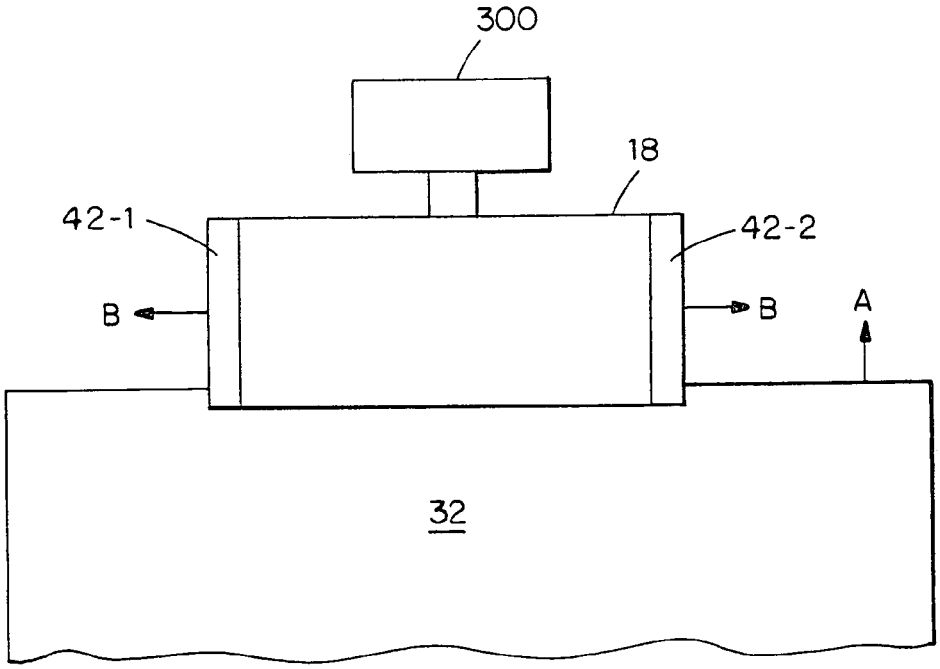
FIG. 12 depicts an alternative embodiment of the printing system with a curing station attached to the movable carriage.

In another embodiment shown in FIG. 12, a curing station 300 is attached directly to the carriage 18. Thus, as the substrate 32 moves intermittently in the direction A through the printing system, ink which had been set by the radiation sources 42-1, 42-2 as the carriage 18 traverses back and forth across the substrate 32 (indicated by the double arrow B—B), is subsequently cured with the curing station 300 which emits radiation with an intensity higher than that of the radiation sources 42-1, 42-2 used to set the ink.

Although in certain embodiments continuous UV radiation sources, such as mercury arc lamps, are used to set the printing fluid or ink, in other embodiments the carriage 18 is provided with a Xenon flash tube to serve as the UV radiation source for setting the fluid. Further, the curing station can be a separate stand alone unit unattached to the base 12 or the carriage 18 of the printing system 10.

Figure 13A:
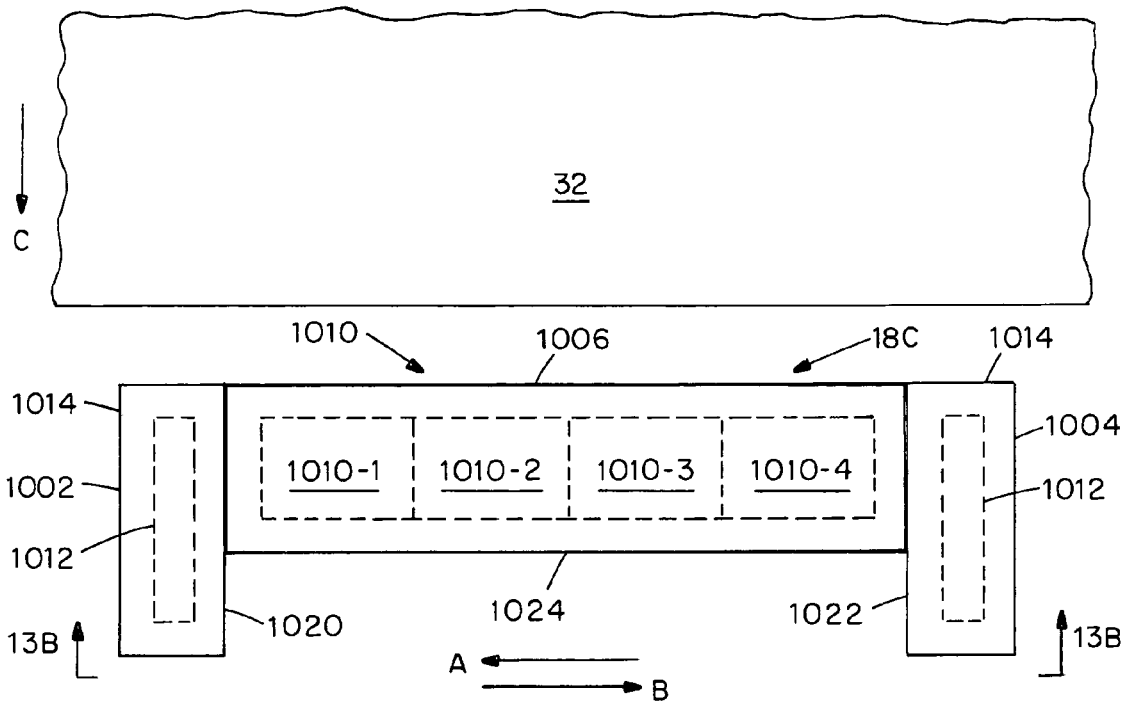
FIG. 13A is a top view of a carriage holding a set of print heads and a pair of UV radiation sources which extend beyond a trailing side of the carriage.
Figure 13B:
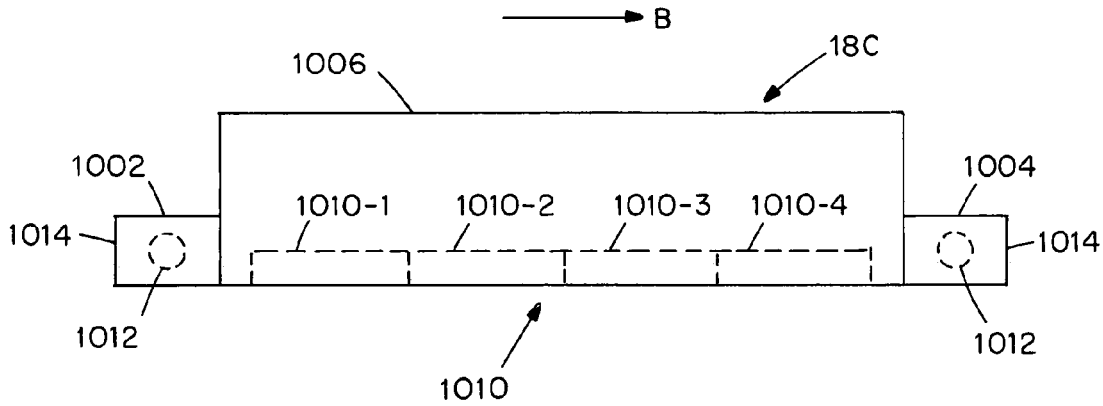
FIG. 13B is a view along the line 13B—13B of the carriage of FIG. 13A.

In another embodiment shown in FIGS. 13A and 13B, the carriage 18 (identified as a carriage 18*c* for this embodiment) of the printing system 10 is provided with a pair of UV energy sources 1002 and 1004 mounted on either lateral side of a housing 1006 of the carriage 18*c*. A series of print heads 1010 (shown in phantom) is also mounted within the housing 1006 and includes a set of black print heads 1010-1, a set of yellow print heads 1010-2, a set of magenta print heads 1010-3, and a set of cyan print heads 1010-4. Each set of print heads can include one or more print heads. Further, different colored print heads can be arranged as shown in FIGS. 13A and 13B, or they may be intermingled.

Figure 14A:
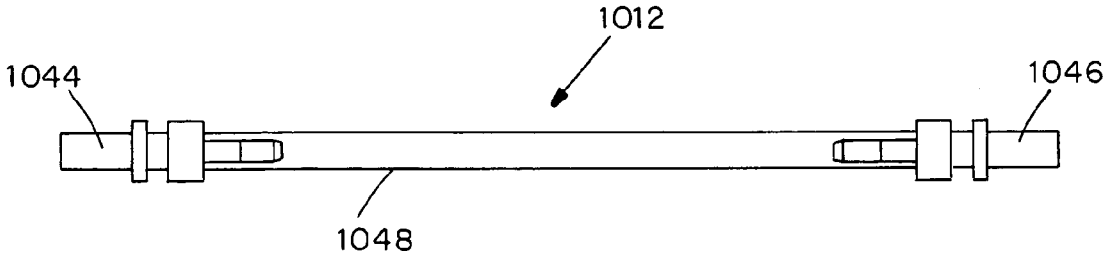
FIG. 14A is an illustration of a lamp able of the UV radiation sources able to emit UV energy at a particular pulse rate.
Figure 14B:
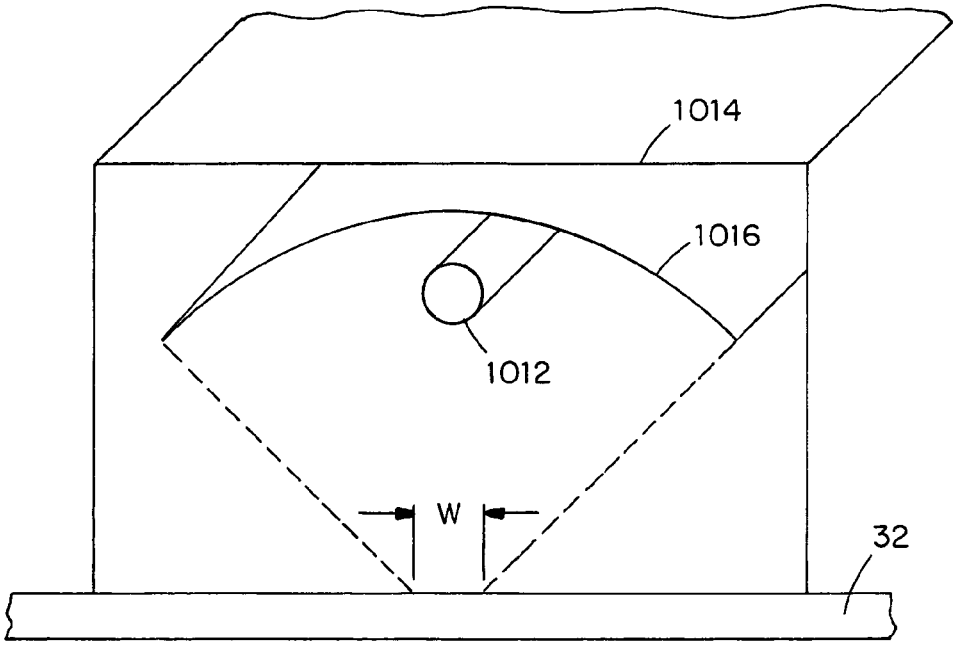
FIG. 14B is a side view of the lamp of FIG. 14A with a lens positioned within a housing.

Referring further to FIGS. 14A and 14B, each of the energy sources 1002 and 1004 includes a lamp 1012 mounted in a lamp housing 1014. A lens 1016 mounted to the housing 1014 above the lamp 1012 focuses the energy emitted by the lamp 1012 across an exposure width, w, at the ink that is deposited on the substrate 32 as it moves the carriage 18*c* when the printing system 10 is in operation. Unlike the carriage 18*b* shown in FIG. 4, the energy sources 1002 and 1004 include a respective portion 1020 and 1022 that extend beyond a trailing edge 1024 of the housing 1006. With such an arrangement, as the carriage 18*c* scans, for example, from right to left over the substrate 32 in the direction A, the trailing energy source 1004 emits a sufficient amount of energy to set the ink deposited onto the substrate 32. As the carriage begins to traverse in the opposite direction B, and the substrate 32 intermittently advances in the direction C, the previous leading energy source 1002 (now trailing) is activated to set the ink which is deposited onto the substrate 32, and the energy source 1004 is turned off. Furthermore, as the substrate moves in the direction C, ink that was deposited onto the substrate 32 in previous passes of the carriage 18*c* and was set by one of the energy sources 1002 and 1004 is now located past the trailing edge 1024 of the housing 1006. Accordingly, this region of the printed image receives additional UV radiation from the extended portions 1020 and 1022 as the respective energy sources are alternately turned on. Thus, the additional energy the ink receives from the extended portions 1020 and 1022 of the energy sources fully cures the ink. Note that although the energy sources 1002 and 1004 described above are used to set and cure UV curable ink deposited from ink jet print heads, these energy sources can be used to set and/or cure any polymerizable fluid that does not necessarily contain a pigment or dye. That is, the low radiation level setting process initiates the polymerization process while the higher radiation level curing process fully cures and hardens the fluid.

Although as mentioned earlier continuous UV radiation sources can be used to set the ink or fluid, since the carriage scans back and forth quite rapidly across the substrate, it is desirable in some situation to use a UV pulsed lamp, such as the Xenon flash lamp mentioned above, as the lamp 1012, which can be turned off and on at very high rates. In the illustrated embodiment, the Xenon flash lamp 1012 is connected to a pulse circuit 1030 shown in FIG. 15. The circuit 1030 includes a pulse forming network 1032 and a trigger 1034 coupled to a DC power supply 1036. The circuit 1030 also includes a charging resistor 1038 and an energy storage capacitor 1040.

The power supply 1036 provides a current to charge the capacitor 1040. When instructed, for example, by a controller 1100, the trigger 1034 triggers the lamp 1012 to release the energy stored in the capacitor 1040 in the form of a current pulse which is then shaped by the pulse forming network 1032 such that an energy spectrum with the appropriate characteristics, such as the optimum wavelength, is produced by the lamp 1012.

Figure 15:
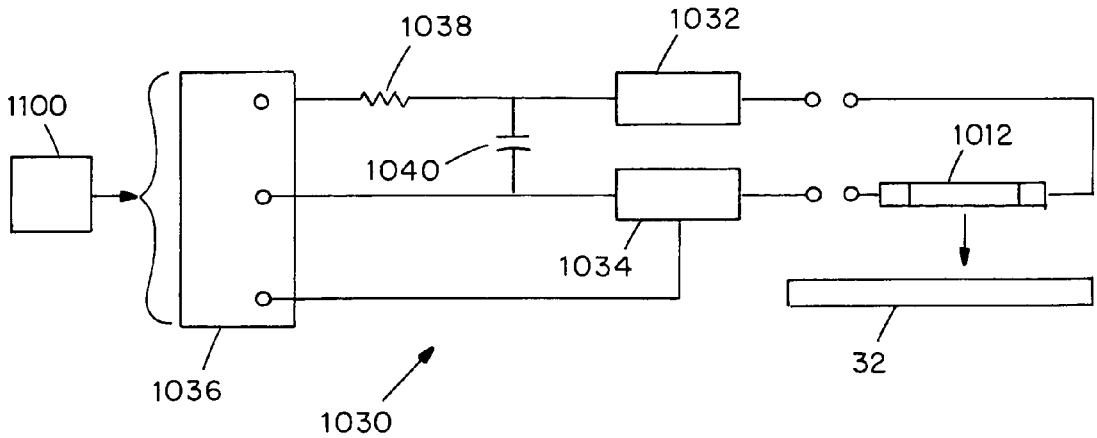
FIG. 15 is a schematic illustration of the electronics of the pulsed UV lamp of FIG. 14A.

As shown in FIG. 14A, the Xenon lamp 1012 includes two electrodes 1044 and 1046 attached to either end of a quartz tube 1048 in which a Xenon gas is sealed. As the pulsed current passes through the Xenon gas via the electrodes 1044 and 1046, the gas converts the current pulses to pulsed light with very high peak power that is transmitted to the substrate 32. The peak power, for example, can be as high as $1\times10^6$ watts. And the pulse rate can be as high as 120 pulses per second. The circuit shown in FIG. 15 provides instant on/off capability so that the lamp 1012 has virtually zero warm-up time since its turn-on times are in the range of only 1 to 5 microseconds.

For the sake of comparison, a 500 watt continuous UV radiation source, such as a mercury arc lamp must operate for 1 sec to produce 500 joules. By way of contrast, the Xenon lamp 1012 having a power output of 500,000 watts delivers 500 joules in one millisecond. Thus by emitting 10 pulses per second, ten times the energy can be delivered to the ink for setting and curing.

Another feature of the pulsed UV lamp 1012 is that it produces significantly less heat than continuous UV lamps. Because the lamp 1012 generates UV radiation in narrow pulses, and there is a cooling period between the pulses, the Xenon gas is excited to useful energy levels without being heated to vapor levels. Accordingly, a minimum amount of IR energy is generated.

The Xenon lamp 1012 and its associated circuitry and operation are described in greater detail in a Technical Paper entitled "Pulsed UV Curing," by Louis R. Panico, published by Xenon Corporation, the contents of which are incorporated herein by reference in its entirety. The Xenon lamp 1012 can be of the type manufactured by Xenon Corporation of Woburn, Mass.

By pulsing the energy to the Xenon lamp 1012, the lamp can be turned on and off quickly to precisely control the pulse rate of the lamp 1012, and hence precisely control the amount of radiant energy transmitted to the ink that is deposited on the substrate.

Figure 16:
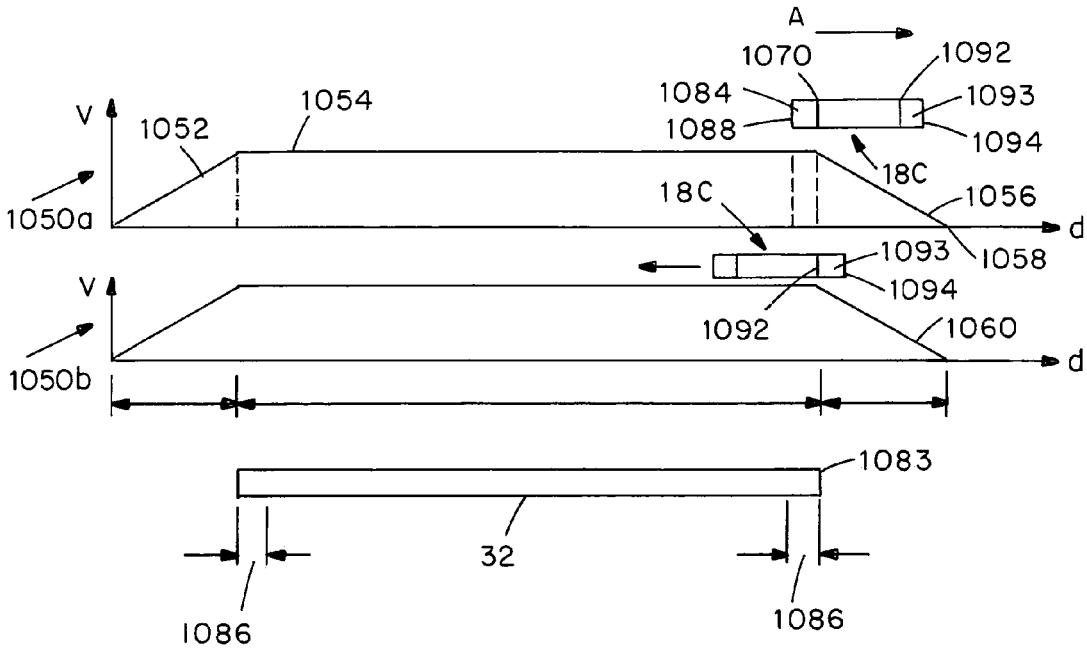
FIG. 16 is an illustration of the velocity profile of the carriage and pair of UV energy sources of FIG. 13 as they scan back and forth across the substrate.

This particular feature of the invention is illustrated by way of example of the velocity profiles 1050*a* and 1050*b* shown in FIG. 16. Typically, as the carriage 18*c* traverses from left to right (arrow A), it accelerates during a period of acceleration 1052, and then continues to scan across the substrate 32 with a constant velocity 1054, and subsequently slows down in a period of deceleration 1056 until it stops 1058 momentarily before it accelerates 1060 as it moves in the opposite direction. For a carriage scanning or traversing across the substrate at a rate of about 60 inches per second, the constant velocity period 1054 is about one second if the substrate is about 60 inches wide. The acceleration period 1052 and the deceleration period 1056 are each about one second. Thus it takes about two seconds to decelerate, turn around, and then accelerate to a constant speed in the other direction. With a continuous UV radiation source such as a mercury lamp, this two second time period is an insufficient amount of time to turn off the lamp since such lamps require warm up periods which significantly exceed this time period. Thus during a typical printing process these mercury lamps remain on during these acceleration and deceleration periods. Accordingly, a significant amount of energy is wasted, and a potential fire hazard may result while the mercury lamp remains on.

Further, in many applications, the carriage 18*c* begins to decelerate as the trailing side 1070 of the carriage 18*c* aligns with the edge 1083 of the substrate 32, for example, when the carriage moves from left to right. However, if the energy output of the trailing energy source 1084 is not reduced, for example, when a continuous UV lamp is employed, the amount of energy the edge region 1086 of the substrate 32 receives is higher since the UV exposure time there is greater.

In contrast, with the pulsed Xenon lamp 1012, the pulse rate can be reduced when the carriage 18*c* begins to decelerate in the region 1056 to ensure that these edge regions 1086 of the substrate 32 do not get overexposed to UV radiation. Further, as the trailing side 1088 of the trailing energy source 1084 aligns with the edge 1083 of the substrate, the lamp can be immediately turned off. Then as the substrate 32 advances through the printing system and as the now trailing side (previously leading) 1092 aligns with the edge 1083, the other lamp 1093 is turned on and its pulse rate increases to a steady rate once the trailing side 1094 of that lamp aligns with the edge 1083.

Another particular feature of the invention is that the pulse rate of the Xenon lamp 1012 is specified in pulses per unit length of linear travel (for example, pulses per inch). That is regardless how fast the carriage 18*c* scans or shuttles across the substrate 32, the amount of energy a given area of the printed image receives is the same, if so desired.

Figure 17:
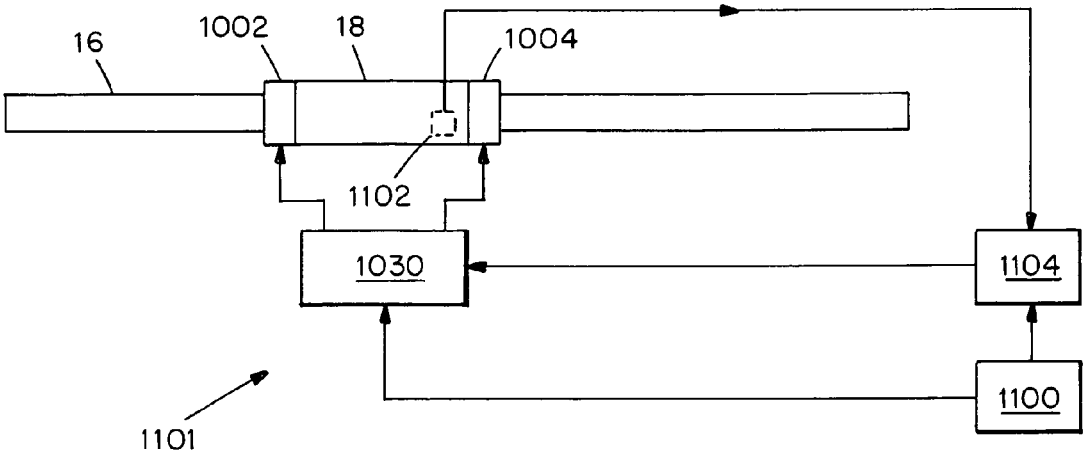
FIG. 17 is a schematic illustration of a feedback mechanism which sets the pulse rate of the pulsed UV lamp of FIG. 13.

The precise control of the pulse rate of the lamp 1012 is provided by a feedback system 1101 shown in FIG. 17. The feedback system 1101 includes an encoder 1102, mounted in the carriage 18*c*, which is coupled to the rail system 16, and connected to a divider 1104 which in turn is connected to a pulse amplifier such as the circuit 1030 described above.

The encoder 1102 can be linear encoder that generates encoder data, such as "ticks" per inch of linear travel, for example, along the rail 16, or it can be a rotary encoder which rolls along the rail 16 but nonetheless provides the same encoder data. In either case, the encoder data is transmitted to the divider 1104 that is under the direction of the controller 1100. The divider takes the ticks per inch and divides it by a number N which can be a fixed number or is a variable that is specified by the operator. Hence, the divider 1104 can be programmable. This information is transmitted to the pulse circuit 1030 so that it pulses at a particular rate. The pulse circuit 1030 also receives instructions from the controller 1100 as to which energy source 1002 or 1004 should be operating. An on-board timer of the controller 1100 enables it to instruct the divider 1104 and the pulse circuit 1030 to reduce or increase the pulses per second as the carriage 18*c* decelerates or accelerates so that the pulses per inch of travel generated by the lamps 1012 remains a constant if desired. Accordingly, the pulse rate (pulses/sec) of the lamp 1012 can be related to the speed of the carriage 18*c* so that the lamp 1012 transmits the same amount of energy per unit area of the substrate regardless at what speed the carriage 18*c* travels. Thus, if the carriage 18*c* moves at 60 inches/sec and the lamp 1012 emits energy at 60 pulses/sec, then the lamp 1012 effectively emits energy at 1 pulse/inch of motion. Further, if the carriage slows down to 30 inches/sec, for example, to print images with higher quality and/or when the carriage 18 decelerates as discussed above, then the feedback system 1101 can automatically instruct the pulse circuit 1030 to reduce the pulse rate of the lamp 1012 to 30 pulses/sec so that the effective pulse rate of the lamp 1012 remains at 1 pulse/inch. Of course, an operator can also vary the amount of energy transmitted per unit area by either increasing or decreasing the pulse rate of the lamp 1012.

Figure 18A:
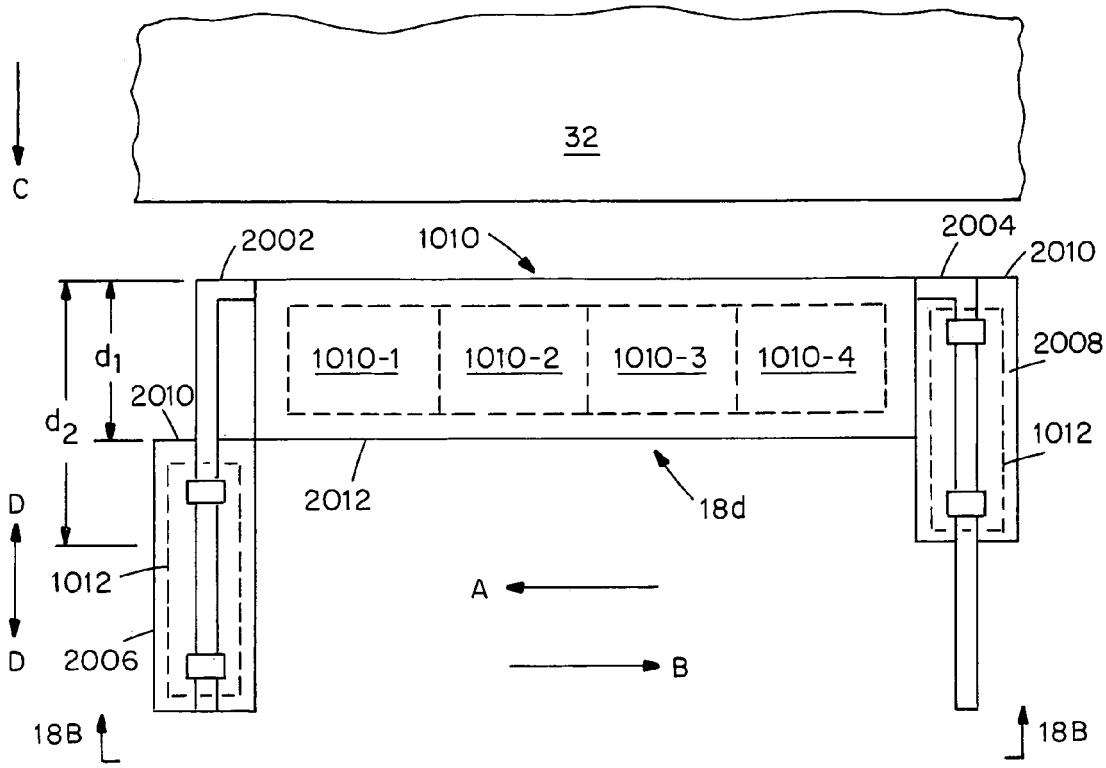
FIG. 18A is top view of an alternative embodiment of a carriage with pulsed UV energy sources of FIG. 13 which are able to move relative to the carriage.
Figure 18B:
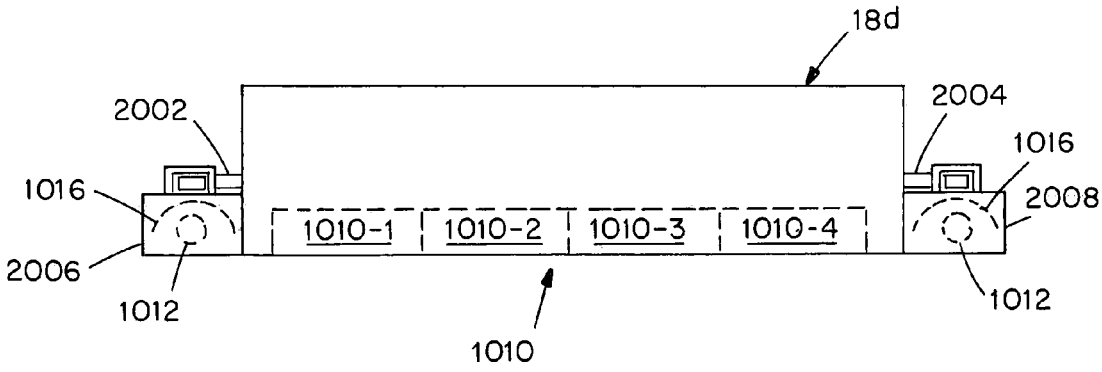
FIG. 18B is a view along the line 18B—18B of the carriage of FIG. 18A.

In an alternative embodiment shown in FIGS. 18A and 18B, the carriage 18 (identified as a carriage 18*d* for this embodiment) is provide with a set of rails 2002 and 2004 along which a pair of pulsed energy sources 2006 and 2008 can move back and forth in the direction of the double arrow D—D. With this arrangement, the energy sources 2006 and 2008 and hence the lamps 1012 can be selectively moved a distance $d_1$ from a retracted state to an extended state. That is, a front side 2010 of either energy sources 2006 and 2008 can be moved to align with the trailing edge 2012 of the carriage portion holding the series of print heads 1010.

With such an arrangement, as the carriage 18*d* moves from left to right (as indicated by arrow A) the trailing energy source 2008, positioned in a retracted state, emits a sufficient amount of UV energy to set the ink deposited onto the substrate and the leading energy source 2006, moved to an extended state, fully cures the ink which was set in a previous pass. Subsequently, after moving in the direction A, the energy source 2006 moves to a retracted state, the energy source 2008 moves to an extended state, the substrate 32 moves an incremental amount in the direction C, and the carriage 18*d* reverses its direction and moves in the direction B. As the carriage 18*d* moves in the direction B, the energy source 2006 sets the presently deposited ink, and the energy source 2008 now moved to an extended state cures the ink deposited and set in a previous pass.

Note that the distance the energy sources 2006 and 2008 are extended can be shorter than $d_1$ or greater than $d_2$ in certain embodiments. The distance the energy sources 2006 and 2008 are extended determines the length of time between when the ink is set and when it is cured. Thus, the time period between the setting and the curing processes is longer when the energy sources 2006 and 2008 are extended to $d_2$ than when extended to $d_1$.

Figure 19A:
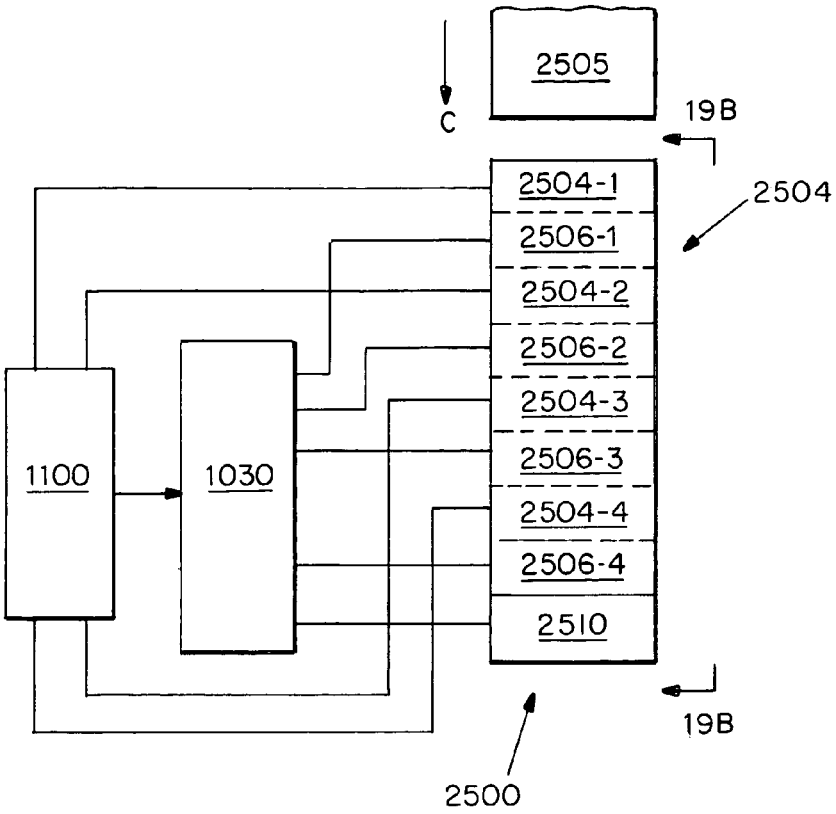
FIG. 19A is top view of a fixed array of print heads with the pulsed UV energy sources of FIG. 13.
Figure 19B:
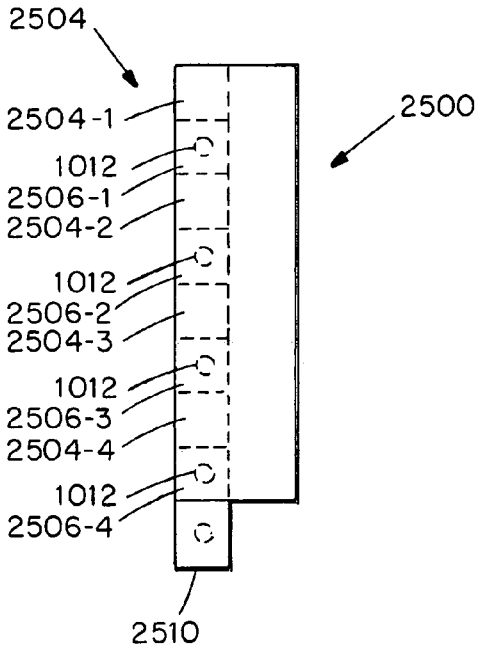
FIG. 19B is a view along the line 19B—19B of the array of print heads of FIG. 19A.

Up to now, the described embodiments of the invention include a series of print heads and UV energy sources mounted to a moveable carriage 18. The carriage 18 can move either bidirectionally or only in one direction. In some applications, however, it is desirable to have a non-moving fixed array of print heads. For example, in FIGS. 19A and 19B, there is shown an embodiment of a non-moving carriage 2500 of a printing system in which a fixed array of print heads 2504 is mounted. These print heads 2504 deposit one or more colored inks from the black print heads 2504-1, the yellow print heads 2504-2, the magenta print heads 2504-3 or the cyan print heads 2504-4 onto a substrate such as a strip 2505 that moves in the direction C. Associated with each set of print heads 2504 is an energy source 2506-1, 2506-2, 2506-3, and 2506-4. These energy sources emit a sufficient amount of UV radiation to set the ink deposited by the print heads 2504-1, 2504-2, 2504-3, and 2504-4, respectively. Under the direction of the controller 1100, the pulse circuit 1030 maintains the individual pulse rate of each energy source 2506. An additional energy source 2510 also under the direction of the controller 1100 via the pulse circuit 1030 emits a higher level of UV radiation to fully cure the deposited ink.

Figure 20A:
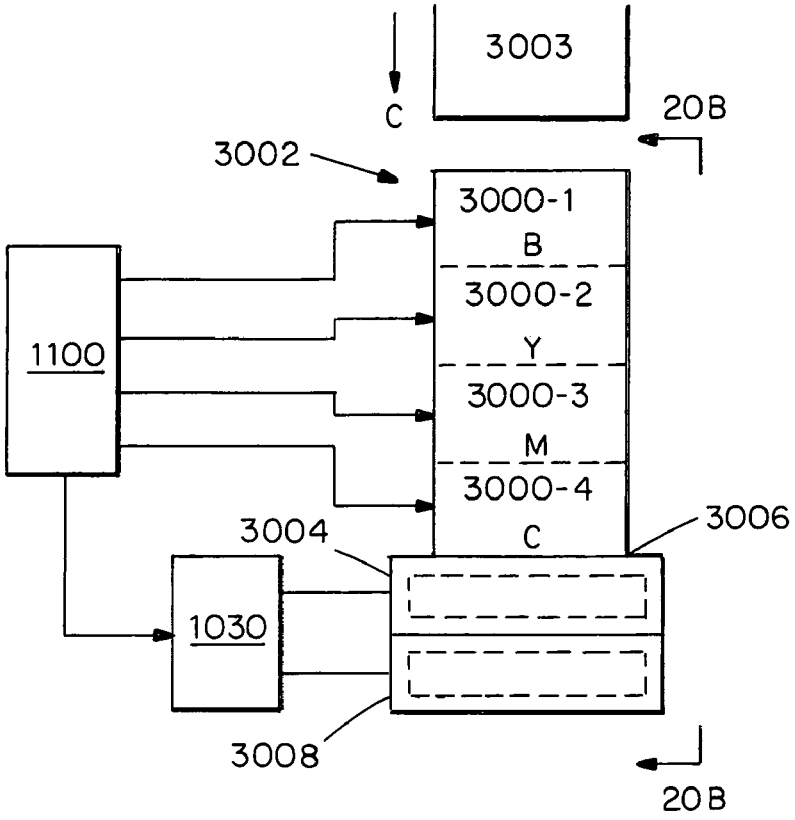
FIG. 20A is a top view of an alternative embodiment of the fixed array of print heads.
Figure 20B:
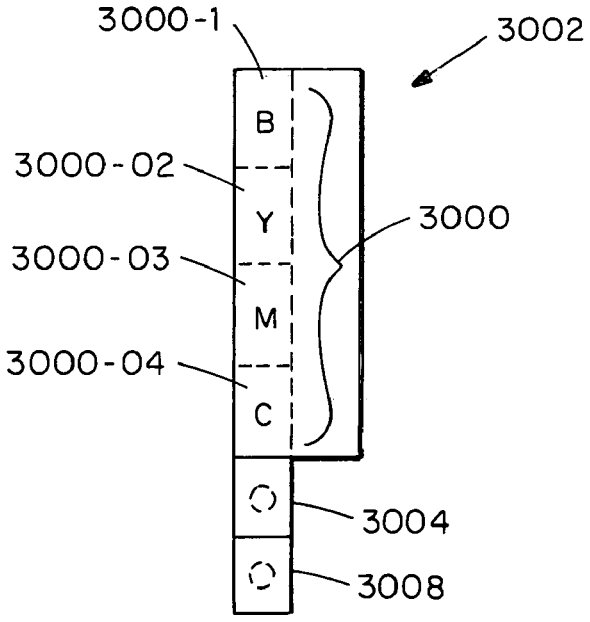
FIG. 20B is a view along the line 20B—20B of the fixed array of print heads of FIG. 20A.

In yet another embodiment, shown in FIGS. 20A and 20B, a series of print heads 3000 are arranged in a non-movable array 3002 which deposit inks onto a strip 3003 that moves underneath the array 3000. In particular, the printheads 3000-1, 3000-2, 3000-3, and 3000-4 deposits black, yellow, magenta, and cyan inks, respectively. A UV energy source (either pulsed or continuous) 3004 is positioned at the trailing edge 3006 of the array 3000 and another UV energy source 3008 is positioned adjacent to the setting UV source 3006. As with the other embodiments, the controller 1100 instructs the pulse circuit 1030 to trigger each energy source 3004 and 3008 at a desired pulse rate in the case when the energy sources 3004 and 3008 are pulsed energy sources. The series of print heads 3000 are also under the direction of the controller 1100.

While this invention has been particularly shown and described with references to preferred embodiments thereof, it will be understood by those skilled in the art that various changes in form and details may be made therein without departing from the scope of the invention encompassed by the appended claims. There can be one or more sets of print heads, and each print head can include one or more print heads. The print heads for each color can be arranged together or they can be intermingled with the print heads for the other colors.

What is claimed is:

1. A printing system, comprising:

a source which emits pulsed UV radiation to polymerize a printing fluid deposited onto a substrate by one or more print heads; and a feedback system which controls the pulse rate of the source, wherein the feedback system converts the pulse rate to pulses per inch of linear travel of the source.

2. The printing system of claim 1, wherein the print heads are adapted to deposit the printing fluid onto the substrate to form an image on the substrate.

3. The printing system of claim 1, wherein an energy level of the radiation emitted by the source is adjustable by varying the pulse rate of the source.

4. The system of claim 3, wherein the level is adjustable from a low level to set the fluid to a higher level to cure the fluid.

5. The system of claim 1, wherein the fluid is first set and subsequently cured.

6. The system of claim 1, wherein the source emits radiation at a level to set the fluid.

7. The system of claim 1, wherein the source emits radiation at a level to cure the fluid.

8. The printing system of claim 1, wherein the print heads are positioned in a carriage which scans in a direction substantially orthogonal to the direction of movement of the substrate, the amount of radiant energy transmitted to the printing fluid being controlled by controlling the pulse rate of the source.

9. The system of claim 8, wherein the carriage is able to move bidirectionally.

10. The system of claim 8, wherein the source is moveable relative to the carriage in a direction substantially parallel to the direction of movement of the substrate.

11. The printing system of claim 1, wherein the source comprises a pair of lamps mounted to a carriage of the printing system, the carriage being coupled to a rail system so that the carriage moves along the rail system to scan across the substrate.

12. The system of claim 11, wherein the lamps are moveable relative to the carriage.

13. The printing system of claim 1, wherein the source comprises a first UV source which sets the liquid and a second UV energy source which cures the liquid, the first UV source being positioned adjacent to the print heads and the second UV source being positioned adjacent to a trailing side of the first UV energy source.

14. The printing system of claim 1, wherein the source comprises one or more setting sources, each setting source being capable of setting the fluid and being positioned adjacent to a respective series of print heads, the source further including a curing source capable of curing the fluid, the curing source being positioned at a trailing end of the array of print heads and the setting energy sources.

15. The system of claim 1, wherein the fluid comprises ink.

16. The printing system of claim 1, wherein the source is mounted laterally adjacent to the print heads relative to the movement of the substrate, the source emitting a set energy sufficient to cause the fluid to set to a non-hardened, quasi-fluid state, the set energy being substantially less than a cure energy required to fully cure the fluid to a hardened state.

17. The system of claim 16, wherein the set energy is about 50% or less than the cure energy.

18. The system of claim 16, wherein an energy level of the radiation source is adjustable from a low level to set the fluid to a higher level to cure the fluid.

19. The system of claim 1, wherein the source comprises a Xenon flash lamp.

20. The method of claim 1, further comprising setting the fluid and subsequently curing the fluid.

21. The method of claim 1, further comprising setting the fluid.

22. The method of claim 1, further comprising curing the fluid.

23. The system of claim 1, wherein the source comprises one or more UV lamps.

24. The system of claim 1, further comprising a second source located adjacent to a trailing edge of the print heads, the second source emitting an energy sufficient to fully cure the fluid.

25. A method for polymerizing a printing fluid, comprising:

depositing the fluid onto a substrate by one or more print heads;

emitting pulsed UV radiation at the printing fluid to polymerize the fluid;

controlling the pulse rate of the UV radiation; and converting the pulse rate to pulses per inch of linear travel of a UV radiation source that emits the UV radiation as it scans across the substrate.

26. The method of claim 25, wherein the print heads are adapted to deposit the fluid onto a substrate to form an image on the substrate.

27. The method of claim 25 further comprising adjusting an energy level of the pulsed UV radiation by varying the pulse rate of the source.

28. The method of claim 27, wherein the level is adjustable from a low level to set the fluid to a higher level to cure the fluid.

29. The method of claim 25, wherein the fluid comprises an ink.

30. The method of claim 25, further comprising emitting radiation at the printing fluid with an energy level sufficient to set the fluid to a non-hardened, quasi-fluid state, the energy level being substantially less than that required to fully cure the fluid to a hardened state.

31. The method of claim 30, wherein the energy level to set the fluid is about 50% or less than the level required to cure the fluid.

* * * * *